US011554940B2

(12) United States Patent
Gril et al.

(10) Patent No.: US 11,554,940 B2
(45) Date of Patent: Jan. 17, 2023

(54) CRANE OR SIMILAR MANIPULATING APPARATUS WITH INTEGRATED ASSEMBLY FOR OVERCOMING EACH DEAD POSITION BETWEEN PRIMARY AND SECONDARY PART OF ITS OPERATIONAL ARM

(71) Applicant: TAJFUN LIV, PROIZVODNJA IN RAZVOJ D.O.O., Postojna (SI)

(72) Inventors: Branko Gril, Prestranek (SI); Iztok Span, Ljubljana (SI)

(73) Assignee: TAJFUN LIV, PROIZVODNJA IN RAZVOJ D.O.O.

( * ) Notice: Subject to any disclaimer, the term of this patent is extended or adjusted under 35 U.S.C. 154(b) by 542 days.

(21) Appl. No.: 16/626,192

(22) PCT Filed: Jun. 29, 2018

(86) PCT No.: PCT/SI2018/000017

§ 371 (c)(1),
(2) Date: Dec. 23, 2019

(87) PCT Pub. No.: WO2019/009818

PCT Pub. Date: Jan. 10, 2019

(65) Prior Publication Data

US 2020/0217094 A1 Jul. 9, 2020

(30) Foreign Application Priority Data

Jul. 3, 2017 (SI) ..... P-201700197

(51) Int. Cl.

| | |
|---|---|
| ***B66C 23/00*** | (2006.01) |
| ***E04G 21/04*** | (2006.01) |
| *B66C 23/68* | (2006.01) |

(52) U.S. Cl.
CPC ..... *B66C 23/545* (2013.01); *E04G 21/0445* (2013.01); *B66C 23/68* (2013.01)

(58) Field of Classification Search
CPC ... E04G 21/0445; B66C 23/42; B66C 23/545; B66C 23/68
See application file for complete search history.

(56) References Cited

U.S. PATENT DOCUMENTS

2014/0263145 A1* 9/2014 Wimmer ..... B66C 23/707 212/299
2015/0344273 A1* 12/2015 Kalkman ..... B66C 23/166 212/270

FOREIGN PATENT DOCUMENTS

EP 1770050 A1 4/2007
WO WO 9204270 A1 3/1992
(Continued)

OTHER PUBLICATIONS

International Search Report and Written Opinion issued in PCT/SI2018/000017 dated Nov. 7, 2018 (12 pages).

*Primary Examiner* — Sang K Kim
*Assistant Examiner* — Nathaniel L Adams
(74) *Attorney, Agent, or Firm* — Haynes and Boone, LLP; William B. Nash

(57) ABSTRACT

A crane apparatus with an integrated assembly for overcoming each dead position between primary and secondary parts of its operational arm includes a bearing framework attached to a chassis and is furnished with at least two telescopic supporting legs that are vertically arranged, and a bearing mast that is connected with the bearing framework, and an operational arm is attached in a pivot point and pivotable around a horizontal axis. The operational arm includes a primary part and a secondary part that are pivotally connected with each other. The secondary part is pivotal around the horizontal axis connected with the primary part of the
(Continued)

operational arm via a dead position overcoming assembly that includes a rotational driving subsystem as well as a mechanism that is attached to part of a hydraulic cylinder for pivoting relative to the secondary part of the operational arm.

5 Claims, 2 Drawing Sheets

(56) References Cited

FOREIGN PATENT DOCUMENTS

| | | |
|---|---|---|
| WO | WO 2013068112 A1 | 5/2013 |
| WO | WO 2016078706 A1 | 5/2016 |

* cited by examiner

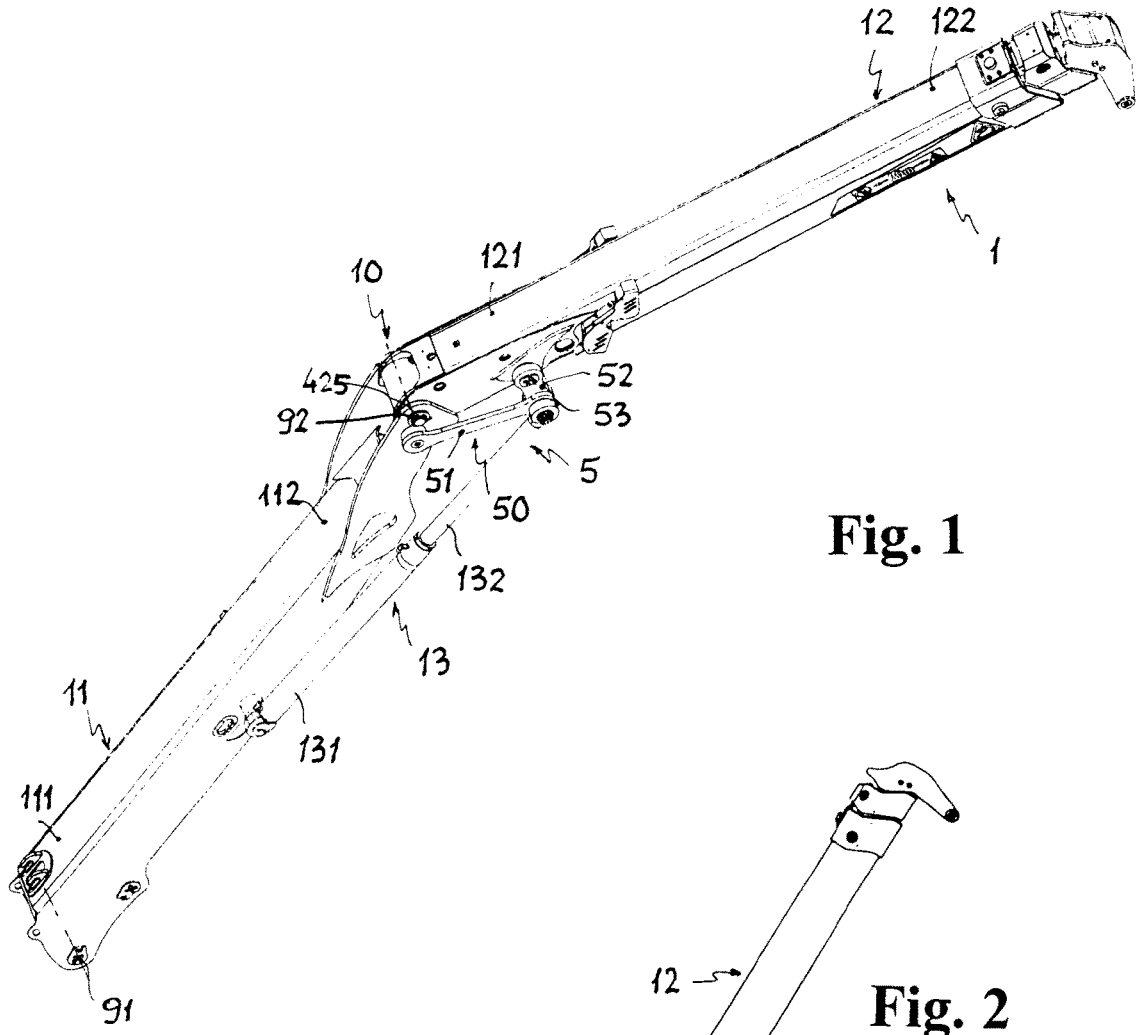
Fig. 1
Fig. 2
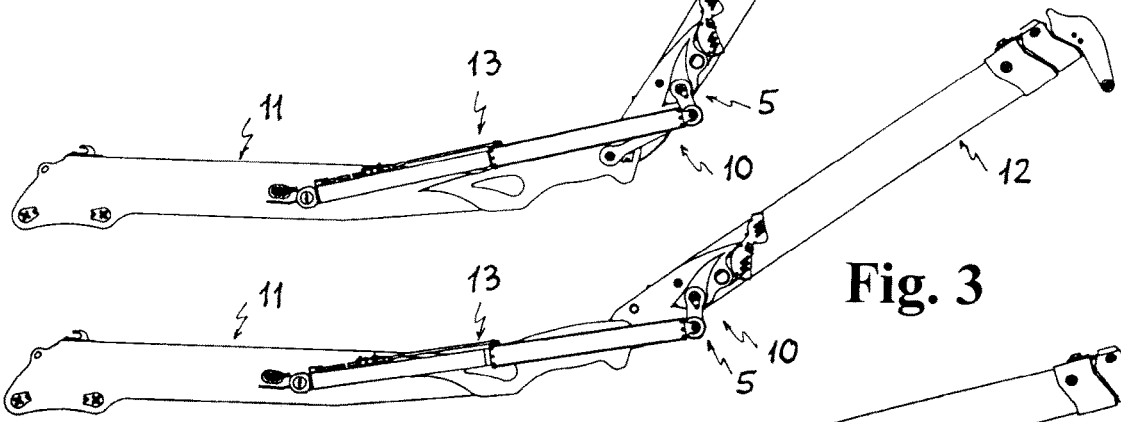
Fig. 3
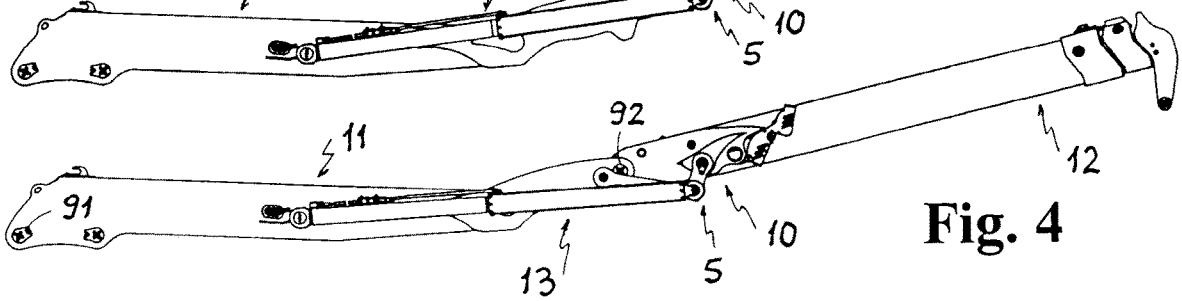
Fig. 4

CRANE OR SIMILAR MANIPULATING APPARATUS WITH INTEGRATED ASSEMBLY FOR OVERCOMING EACH DEAD POSITION BETWEEN PRIMARY AND SECONDARY PART OF ITS OPERATIONAL ARM

CROSS-REFERENCE TO RELATED APPLICATIONS

This application is a United States national phase application of co-pending international patent application number PCT/SI2018/000017, filed on Jun. 29, 2018, which claims the benefit of Slovenia Patent Application No. P-201700197, filed on Jul. 3, 2017, both which are hereby incorporated by reference in their entireties.

BACKGROUND

The present disclosure refers to a crane or similar manipulating apparatus with integrated assembly for overcoming each dead position between primary and secondary part of its operational arm, namely each position in aligned position of said parts of the operational arm of a crane or similar working apparatus, which is impossible for overcoming just by means of a hydraulic cylinder with a piston, which is usually used for adjustment of each mutual position of said parts of the operational arm.

The purpose of the present disclosure is to create a crane or similar manipulating apparatus, which should be furnished with an operational arm assembled of at least two pivotally interconnected parts, namely a of primary part and of a secondary part, and each desired position of said parts relatively to each other at each desired angle between them should be adjusted by means of a hydraulic cylinder with a piston, so that the casing of said cylinder would be attached to one part of the arm and the piston inserted therein together with a piston rod should be attached to the other part of the operational arm, wherein each dead position, namely a position in which the pivot point between said parts of the arm is located on the line extending through both points, in which the cylinder is attached to each of said parts of the arm, or in the proximity of said line, i.e. in position, in which said parts of the arm are substantially aligned and the lines through said pivot point between the parts of the arm and each attachment point of a cylinder on each part of the arm extend at an angle of approximately 180°, or at least 180°±approx. 10°, namely in a position in which said hydraulic cylinder is in due to said angular situation of approximately 180°, either by pushing or by pulling unable to performing any further pivoting of said parts one relatively to the other, such dead position would have to be overcome by means of a suitable auxiliary means, which however would have be surmounted to the crane in such manner, that the bearing capacity, operational area, foldability and other commonly known properties of the state of the art cranes would not be hindered, and moreover, that also the overall appearance of the crane or similar manipulating apparatus would remain practically unchanged.

Those skilled in the art are familiar with various cranes, which are suitable for attachment to a chassis of a truck and comprise a bearing framework, which is usually furnished with at least two supporting legs and comprises at least vertically arranged mast, to which an operational arm is attached by means of its primary part and pivotally around the vertical geometric axis. Said operational arm consists of a primary part as well as of a secondary part, and can be pivoted relatively to said mast by means of a hydraulic cylinder with a piston, wherein one part of said cylinder, e.g. a casing, is attached to said mast, and the other part, e.g. a piston road with a piston inserted into said casing, is connected with said primary part of the operational arm. Quite analogously, a secondary part of the operational arm is pivotally connected with said primary part of the operational arm and is optionally telescopically conceived. Also the second part of the arm can be pivoted relatively to said primary part of the arm around the horizontal axis by means of a hydraulic cylinder with a piston, a part of which, e.g. a casing, is attached to the primary part, while its other part, i.e. a piston rod with a piston inserted into said casing, is connected to the secondary part of the operational arm. Each proper gripping or manipulating accessory is by means of a pivot joint or a rotational unit, a so-called rotator, attached to the free end portion of the secondary part of the arm. Prior to operation, e.g. by transporting said crane or similar manipulating apparatus, said primary part of the operational arm is usually located adjacent to the mast, and the secondary part is located adjacent to said primary part. Just prior to activation of the crane of manipulating apparatus said primary part is moved apart from the mast, by which a problem of the so-called dead position may occur, in which a hydraulic cylinder is directed practically towards the pivot point between the mast and the primary part of the arm, and the moment lever becomes insufficient for generating a required torque by means of said cylinder, which could enable pivoting of said pretty heavy primary part together with the secondary part attached thereto relatively to said mast. To this aim, DE 27 48 675 proposes that an additional hydraulic cylinder should be mounted in the area of said mast, and a piston rod of said cylinder should be movable transversely with respect to said mast and in a direction towards the primary part of the operational arm. By means of said additional cylinder said primary part of the operational arm is prior to activation of said main operational cylinder pivoted from its initial position adjacent to the mast for a suitable angle, by which a sufficient moment lever is established, which is sufficient for generation of a torque by means of the main operating cylinder between the mast and the primary part of the operational arm. Such concept may be successful in resolving said problem of overcoming a dead position of two parts, which are rest on each other and the angle between them is approximately 0°, but is completely inefficient by overcoming said dead position in another possible situation, when said parts are at mutually least approximately aligned and the angle between them is approximately 180°.

Overcoming such dead position in the lastly mentioned circumstances is nowadays in the practice at least by so-called Z-cranes performed in such a way, that initially by means of a hydraulic cylinder, which is in both attaching points connected with the primary part and the secondary part of the arm said parts are situated at an angle closely to 180° relatively to each other, upon which by means of the other cylinder attached to the mast and the primary arm said arm is lowered towards the ground until each operational accessory on the secondary part of the arm is rest on the ground. Upon that, by releasing said cylinder between the primary part and the secondary part of the arm said parts due to their own weight start falling towards the ground, by which said angle of 180° between them can be overcome and changed for such extent that a suitable position of said parts is established, in which the cylinder is then able to start pivoting the secondary part relatively to the primary part of the operational arm. The problem is, that by overcoming said dead position each operational accessory, which is rest on the ground, due to pure cinematic conditions performs an essential translatory movement along the ground, which often results in undesired ruining the ground, which in particular in urban areas leaves visible and durable damages. In order to avoid such consequences, EP 2 248 753 A1 proposes a further approach, according to which on a primary part of the operational arm in addition to a hydraulic cylinder for displacing the secondary part relatively to the primary part an additional driving means is foreseen, which is activated exclusively by overcoming of dead position between the primary and a secondary part, when these are mutually aligned at the angle approximately 180° between them. Said additional driving means may e.g. be a hydraulic cylinder, a casing of which is attached to the primary part of the arm, and on the piston rod of which a chain is attached, which is in the other hand attached to the secondary part of the arm and herewith establishes a lever, which is necessary for generating a torque as required for overcoming said dead position. Another embodiment provides that said additional operational means is a tandem of hydraulic cylinders, which is able to generate appropriate force couple and herewith a torque, which is then used for overcoming a dead position. However, both the first and the second embodiment normally involve integration of a plurality of additional components, which are from technical aspects pretty complicated and must in addition to that be placed on the external surface of the crane or similar manipulating machine and are then exposed to weather conditions, which may in the practice lead to various inconveniences during the operation including additional difficulties by transforming between the collapsed initial position and extended operational position, much more comprehensive maintenance of all these additional components, and some additional risk in view of reliability of operation in situ.

The present disclosure refers to a crane or similar manipulating apparatus with integrated assembly for overcoming each dead position between primary and secondary part of its operational arm. Such crane or similar manipulating apparatus comprises at least a sufficiently rigid bearing framework, which is adapted for attachment to a suitable chassis and is optionally furnished with at least two optionally telescopic supporting legs, as well as an at least approximately vertically arranged and sufficiently rigid bearing mast, which is in the area of its first end portion connected with said bearing framework, while in the area of its second end portion an operating arm is attached in a pivot point, in which said arm is pivotable around the horizontal axis. Said operational arm consists of a rigid primary part, the first end portion of which is in said pivot point pivotally around the horizontal axis attached to said bearing mast, while its second end portion is in a pivot point pivotally around the horizontal axis connected with the first end portion of a rigid secondary part, to the second end portion of which a gripping assembly or a similar manipulating accessory of each crane or working machine is attached.

Said secondary part of the operational arm is in said pivot point pivotable relatively to said first part by means of a hydraulic cylinder with a piston, a part of which, namely either its casing or a piston rod together with a piston inserted therein, is attached to the primary part of the arm, while each residual part of said cylinder is attached to the secondary part of the arm. Said operational arm is pivotally relative to said bearing mast by means of a hydraulic cylinder with a piston, a part of which, namely either its casing or a piston rod together with a piston inserted therein, is attached to the mast, while each residual part of said cylinder is attached to the primary part of the operational arm.

In accordance with the present disclosure, said secondary part is in the area of said pivot point pivotally around the horizontal axis connected with the primary part of the operational arm by means of a dead position overcoming assembly, wherein said assembly comprises a rotational driving means as well as a mechanism, which is suitable for attachment of that part of a hydraulic cylinder for pivoting of the secondary part relatively to the secondary part of the operational arm, which is attachable to said second part of the arm.

Said rotational driving means is arranged in the area of said pivot point for pivoting of the secondary part of the arm relatively to the primary part. Said rotational driving means (4) is arranged in the area of said pivot point and consists of a casing as well as of a central part, which is inserted therein. Said casing is firmly and with the possibility of transferring a torque connected with the secondary part of the arm and represents a casing of a hydraulic cylinder with hydraulic connectors, which are in the horizontal direction spaced apart from each other. Said central part is with the possibility of transmission of torque around the horizontal axis through said pivot point between the primary part and said secondary part of the arm connected with the primary part of the arm and represents a piston of said hydraulic cylinder, which is movable to and fro along said horizontal axis in the pivot point. At the same time, said casing and said central part are conceived as parts of a clutch, so that on the one hand said casing is furnished with protrusions, which are in the circumferential direction equidistantly spaced apart from each other and each of them is furnished with two axially outwards converging slopes, and on the other hand also the central part is furnished with protrusions, which are in the circumferential direction equidistantly spaced apart from each other and protrude towards said protrusions on said casing, and each of them is also furnished with two axially outwards converging slopes. Each said protrusions on the central part is formed complementary with each gap between each two neighboring protrusions on said casing, and the inclination of slopes on each protrusion on the central part corresponds to inclination of slopes on each protrusion on the casing. Consequently, if said cylinder for pivoting said secondary part relatively to said primary part of the arm is temporarily deactivated, thanks to mutual engagement of said protrusions on the casing and on the central part, each displacement of the central part in axial direction of the casing, namely along the horizontal axis within said pivot point, results in a synchronously rotation of the central part relatively to the casing, or vice versa.

Said mechanism, on which said cylinder for pivoting said secondary part relatively to said primary part of the arm is attached, is conceived as a crank mechanism, which consists of a L-shaped lever, the shorter arm of which is on its free end portion pivotally around the horizontal axis attached to a primary part of the operational arm adjacent to said pivot point between the primary part and the secondary part of the operational arm, its longer arm is pivotally around the horizontal axis attached to a secondary part of the operational arm at certain distance apart from said pivot point, and in the coinciding area of said arms, said hydraulic cylinder for pivoting said secondary part relatively to said primary part of the arm is pivotally around the horizontal axis attached by means of its one part, while the other part of said cylinder is pivotally around the horizontal axis attached to the primary part of the operational arm.

In a preferred embodiment of the present disclosure the casing of the rotational driving means is welded to the secondary part of the operational arm.

The present disclosure further provides that the central part of the rotational driving means is placed on a spline shaft, which extends through the primary part coaxially with said horizontal axis of the pivot point between the primary part and the secondary part of the operational arm. In this, the central part as such is conceived as a spline shaft and is on the one hand furnished with a central splined passage and on the other hand with longitudinal surface grooves, along which and consequently also along said horizontal axis is with the possibility of transmission of a torque displaceable said hydraulic piston, which is furnished with said protrusions and slopes.

The present disclosure further provides, that the intermediate area between the casing and the central part i.e. the piston of the rotational driving means is adapted to receive a hydraulic media, which is supplied via hydraulic connectors and is to this aim hydraulically connectable to a hydraulic circuit, which is simultaneously intended for powering said cylinder for pivoting the secondary part of the operational arm relatively to the primary part thereof, wherein in said hydraulic circuit during the stage of approaching to dead position, in which the pivot point between the primary part and the secondary part of the operational arm is located on a line, which extends through the attachment points of the hydraulic cylinder on the first part and the second part of the operational arm, activation of said rotational driving means is enabled, while during the stage of leaving said dead position said rotational driving means is deactivated.

In one of possible embodiment of the present disclosure said secondary part of the operational arm is telescopically conceived.

BRIEF DESCRIPTION OF THE DRAWINGS

The present disclosure will be described in detail on the basis of an embodiment of a crane or similar manipulating apparatus as presented in the attached drawings, in which FIG. 1 a primary and secondary part of an operational arm of a crane or similar manipulating apparatus together with accompanying cylinder and dead position overcoming assembly during pivoting said secondary part of the arm relatively to said primary part;

FIG. 2 a primary and secondary part of an operational arm of a crane or similar manipulating apparatus together with accompanying cylinder and dead position overcoming assembly by approaching the area of a dead position;

FIG. 3 a primary and secondary part of an operational arm of a crane or similar manipulating apparatus together with accompanying cylinder and dead position overcoming assembly just in the area of a dead position;

FIG. 4 a primary and secondary part of an operational arm of a crane or similar manipulating apparatus together with accompanying cylinder and dead position overcoming assembly upon overcoming said dead position;

DETAILED DESCRIPTION

Figure 5:
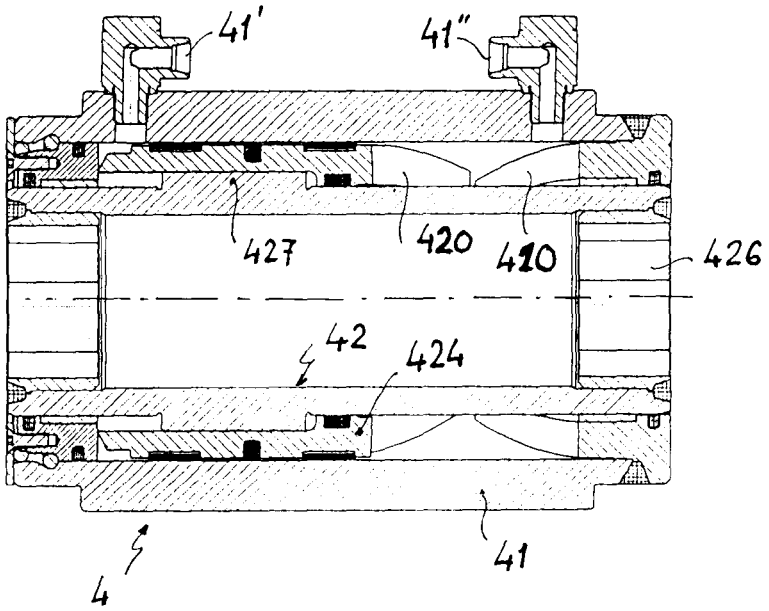
FIG. 5 is a driving assembly of said dead position overcoming assembly in a cross-section along its diametrical plane.
Figure 6:
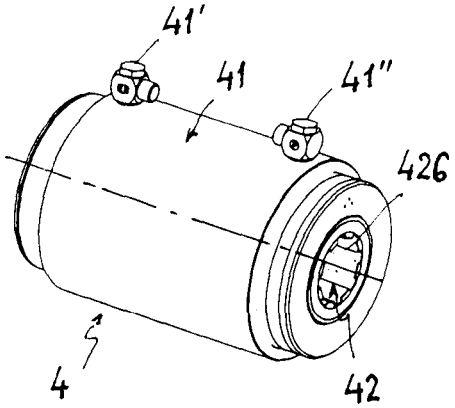
FIG. 6 is isometric view of said driving means according to FIG. 5.
Figure 7:
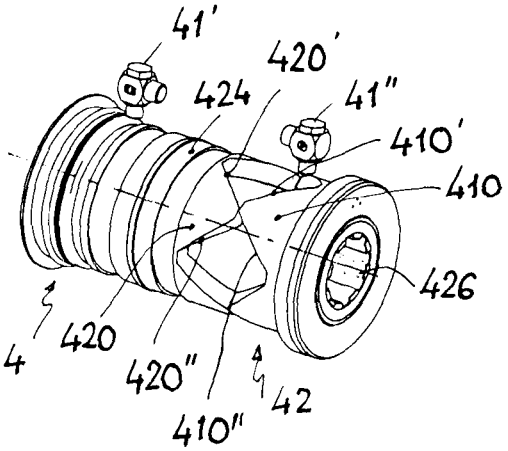
FIG. 7 is isometric view of said driving means according to FIGS. 5 and 6, however without accompanying casing.

A crane or similar manipulating apparatus with integrated assembly 10 for overcoming of a dead position of a primary part 11 and secondary part 12 of an operational arm 1 is presented in FIG. 1, and various situations, which occur by pivoting said secondary part 12 relatively to said primary part 11 of the operational arm 1, are presented in FIGS. 1-4, including said overcoming said dead position (FIG. 3).

A discussed crane or similar manipulating apparatus is in this particular case a truck crane, which is e.g. suitable for transporting of logs, but can however also be an excavator or a foldable construction for bearing of a flexible distributing pipe on a vehicle for transporting of liquid mortar.

Such crane or similar manipulating apparatus comprises at least a sufficiently rigid bearing framework, which is adapted for attachment to a suitable chassis and is optionally furnished with at least two optionally telescopic supporting legs, as well as at least approximately vertically arranged and sufficiently rigid bearing mast, which is in the area of its first end portion connected with said bearing framework, while in the area of its second end portion an operating arm 1 is attached in a pivot point 91, so that said arm is pivotable around the horizontal axis.

Said operational arm 1 consists of a rigid primary part 11, the first end portion 111 of which is in said pivot point 91 pivotally around the horizontal axis attached to said bearing mast, while its second end portion 112 is in a further pivot point 92 pivotally around the horizontal axis connected with the first end portion 121 of a rigid secondary part 12, to the second end portion 122 of which a gripping assembly or a similar manipulating accessory of each crane or working machine is attached.

Said secondary part 12 of the operational arm 1, which is in this particular case due to extension of manipulating range of the arm 1 and herewith also the crane a such telescopically conceived, is in said pivot point 92 pivotable relatively to said first part 11 by means of a hydraulic cylinder 13 with a piston, a part of which, namely either its casing 131 or a piston rod 132 together with a piston inserted therein, is attached to the primary part 11 of the arm 1, while each residual part 131, 132 of said cylinder 13 is attached to the secondary part 12 of the arm 1.

Moreover, said operational arm 1 is pivotally relative to said bearing mast by means of a hydraulic cylinder with a piston, a part of which, namely either its casing or a piston rod together with a piston inserted therein, is attached to the mast, while each residual part of said cylinder is attached to the primary part 11 of the operational arm 1.

In the sense of the proposed present disclosure, said secondary part 12 is in the area of said pivot point 92 pivotally around the horizontal axis connected with the primary part 11 of the operational arm 1 by means of a dead position overcoming assembly 10, wherein said assembly 10 comprises a rotational driving means 4 as well as a mechanism 5, which is suitable for attachment of that part of a hydraulic cylinder 13 for pivoting of the secondary part 12 relatively to the secondary part 12 of the operational arm 1, which is attachable to said second part 12 of the arm 1.

The rotational driving means 4 is arranged in the area of said pivot point 92 for pivoting of the secondary part 12 of the arm 1 relatively to the primary part 12, or vice versa. In this, said rotational driving means 4 consists of a casing 41 as well as of a central part 42 inserted therein. Said casing 41 is firmly and with the possibility of transferring a torque connected with the secondary part 12 of the arm 1 and represents a casing of a hydraulic cylinder with hydraulic connectors 41', 41", which are in the horizontal direction spaced apart from each other. In the shown embodiment, said casing 41 is welded to the secondary part 12 of the operational arm 1. Said central part 42 is with the possibility of transmission of torque around the horizontal axis through said pivot point 92 between the primary part 11 and said secondary part 12 of the arm 1 connected with the primary part 11 of the arm 1 and substantially represents a piston 424 of said hydraulic cylinder, which is movable to and fro along said horizontal axis in the pivot point 92.

Said casing 41 and said central part 42 are conceived substantially as parts of a clutch, for example a jaw coupling i.e. a dog clutch. Consequently, on the one hand said casing 41 is furnished with protrusions 410, which are in the circumferential direction equidistantly spaced apart from each other and each of them is furnished with two axially outwards converging slopes 410', 410". On the other hand, also the central part 42 is furnished with protrusions 420, which are in the circumferential direction equidistantly spaced apart from each other and protrude towards said protrusions 410 on said casing 41, and each of them is also furnished with two axially outwards converging slopes 420', 420". Each of said protrusions 420 on the central part 42 is formed complementary with each gap between each two neighboring protrusions 410 on said casing 41, and inclination of slopes 420', 420" on each protrusion 420 on the central part corresponds to inclination of slopes 410', 410" on each protrusion 410 on the casing 41. When said cylinder 13 for pivoting said secondary part 12 relatively to said primary part 11 of the arm 1 temporarily deactivated, thanks to such concept and thanks to mutual engagement of said protrusions 410, 420 on the casing 41 as well as on the central part 42, each displacement of the central part 42 in axial direction of the casing 41, namely along the horizontal axis within said pivot point 92, results in a synchronous rotation of the central part 42 relatively to the casing 41, or vice versa.

Said mechanism 5, on which said cylinder 13 for pivoting said secondary part 12 relatively to said primary part 11 of the arm 1 is attached, is conceived as a crank mechanism, which consists of a L-shaped lever 50, the shorter arm 51 of which is on its free end portion pivotally around the horizontal axis attached to a primary part 11 of the operational arm 1 adjacent to said pivot point 92 between the primary part 11 and the secondary part 92 of the operational arm 1, its longer arm 52 is pivotally around the horizontal axis attached to a secondary part 12 of the operational arm 1 at certain distance apart from said pivot point 92. In the coinciding area 53 of said arms 51, 52, said hydraulic cylinder 13 for pivoting said secondary part 12 relatively to said primary part 11 of the arm 1 is pivotally around the horizontal axis attached by means of its one part 131, 132, while the other part 131, 132 of said cylinder 13 is pivotally around the horizontal axis attached to the primary part 11 of the operational arm 1. Those skilled in the art will no doubt understand that also a further embodiment is possible, in which a casing 131 of the hydraulic cylinder is attached to the lever 50, while the piston rod 132 is in such case attached to the primary part 11 of the arm 1.

In the shown embodiment the central part 42 of the rotational driving means 4 is placed on a spline shaft 425, which extends through the primary part 11 coaxially with said horizontal axis of the pivot point (92) between the primary part 11 and the secondary part 12 of the operational arm 1. Also the central part 42 as such is conceived as a spline shaft 425 and is on the one hand furnished with a central splined passage 426 and on the other hand with longitudinal surface grooves 427. Along said grooves 427 and consequently also along said horizontal axis is then with the possibility of transmission of a torque displaceable said hydraulic piston 424, which is furnished with said protrusions 420 and slopes 420', 420".

In the shown embodiment the intermediate area between the casing 41 and the central part 42 i.e. the piston 424 of the rotational driving means 4 is adapted to receive a hydraulic media, which is supplied via hydraulic connectors 41', 41" and is to this aim hydraulically connectable to a hydraulic circuit, which is simultaneously intended for powering the cylinder 13 for pivoting the secondary part 12 of the operational arm 1 relatively to the primary part 11 thereof.

Moreover, in the shown embodiment said hydraulic circuit is conceived in such manner that during the stage of approaching to dead position, in which the pivot point 92 between the primary part 11 and the secondary part 12 of the operational arm 1 is located on a line, which extends through the attachment points of the hydraulic cylinder 13 on the first part 11 and the second part 12 of the operational arm 1, activation of said rotational driving means 4 is enabled, while during the stage of leaving said dead position said rotational driving means 4 is deactivated.

Therefore, each displacement of said piston 424 results in rotation of the central part 42 relatively to the casing 42 of the rotational driving means 4 and, as a consequence, also pivoting of the secondary part 12 of the arm 1 relatively to the primary part 11 thereof. By suitable arranging said protrusions 410, 420 along the circumference of the casing 41 and the central part 42 relatively to each corresponding parts 11, 12 of the arm 1, said pivoting occurs exactly in the stage of transition of the dead position by pivoting said secondary part 12 of the arm 1 relatively to the primary part 11 thereof in the area of the pivot point 92. Namely, when the secondary part 12 of the arm 1 is pivoted apart from the primary part 11 towards the position according to FIG. 4, the hydraulic cylinder at a sufficient lever produces a sufficient torque, which enables pivoting of the secondary part 12. In a position (FIG. 3), in which the arm 1 is extended and said parts 11, 12 are substantially aligned, the pivot point 92 is located on the line through the attachment locations of the cylinder 13, or just proximal to said line, so that each disposable lever for producing a torque by said cylinder 13 is reduced to such extent that the produced torque becomes insufficient for any further pivoting of said secondary part 12. In such position said cylinder is temporarily deactivated by simultaneously activating said rotational driving means 4, which then takes-over each further pivoting of the secondary arm 12 of the arm 1 relatively to the primary part 11 thereof for at least an angle, which is sufficient for re-establishing of a lever, which again allows producing such torque, which is required for continuation of pivoting of the secondary part 12 relatively to the primary part 11.

What is claimed is:

1. A crane apparatus, comprising:

a rigid bearing framework, which is adapted for attachment to a chassis and is furnished with at least two telescopic supporting legs;

an approximately vertically arranged and rigid bearing mast, which is in an area of its first end portion connected with said bearing framework, while in an area of its second end portion an operational arm is attached in a first pivot point, in which the operational arm is pivotable around a horizontal axis, wherein the operational arm includes a rigid primary part, a first end portion of the rigid primary part with a first pivot point, a second end portion of the rigid primary part with a second pivot point, a rigid secondary part, a first end portion of the rigid secondary part, and a second end portion of the rigid secondary part;

wherein the rigid secondary part of the operational arm is pivotable around the second pivot point relative to the rigid primary part via a first hydraulic cylinder that is attached at a first end to the rigid primary part of the operational arm and at the second end to the rigid secondary part of the operational arm;

wherein the rigid secondary part is connected with the rigid primary part via a dead position overcoming assembly, wherein the dead position overcoming assembly includes a rotational driving subsystem as well as a mechanism for attachment of the first hydraulic cylinder to the rigid secondary part of the operational arm, wherein the rotational driving subsystem is in the area of the second pivot point for pivoting of the rigid secondary part of the operational arm relative to the rigid primary part of the operational arm, and wherein the rotational driving subsystem includes a casing, which is firmly, and with the possibility of transferring a torque, connected with the rigid secondary part of the operational arm, and wherein the casing has a hydraulic cylinder with hydraulic connectors, the hydraulic connectors are in a horizontal direction spaced apart from each other, and a central part, and wherein the casing and the central part form parts of a clutch, the casing is furnished with first protrusions which are in a circumferential direction equidistantly spaced apart from each other and each protrusion is furnished with two axially outward first converging slopes, and the central part is furnished with second protrusions which are in a circumferential direction equidistantly spaced apart from each other and protrude towards the first protrusions on the casing, and each of the second protrusions is furnished with two axially outwards second converging slopes, wherein each of the second protrusions on the central part is formed complementary with each gap between each two neighboring first protrusions on the casing, and wherein a second inclination of the second converging slopes on each second protrusion on the central part corresponds to a first inclination of the first converging slopes on each first protrusion on the casing such that the first hydraulic cylinder for pivoting the rigid secondary part relative to the rigid primary part of the operational arm is temporarily deactivated due to a mutual engagement of the first and second protrusions on the casing as well as on the central part, and each displacement of the central part in an axial direction of the casing along the horizontal axis within the second pivot point results in a synchronous rotation of the central part relative to the casing, and wherein the mechanism for attachment on which the first hydraulic cylinder for pivoting the rigid secondary part of the operational arm relative to the rigid primary part of the operational arm is attached, forms a crank mechanism that includes an L-shaped lever, a shorter arm which is on a free end portion pivotal around a horizontal axis attached to the rigid primary part of the operational arm adjacent to the second pivot point, and a longer arm is pivotal around a horizontal axis attached to the rigid secondary part of the operational arm at a distance apart from the second pivot point, and in a coinciding area of the shorter arm and longer arm the second end of the first hydraulic cylinder is attached for pivoting the rigid secondary part of the operational arm relative to the rigid primary part of the operational arm around a horizontal axis and the first end of the first hydraulic cylinder is pivotally attached to the rigid primary part of the operational arm.

2. The crane apparatus of claim 1, wherein the casing of the rotational driving subsystem is welded to the rigid secondary part of the operational arm.

3. The crane apparatus of claim 1, wherein the central part of the rotational driving subsystem is placed on a spline shaft, which extends through the rigid primary part coaxially with a horizontal axis of the second pivot point between the rigid primary part and the rigid secondary part of the operational arm, and the central part is a spline shaft and is furnished with a central splined passage and longitudinal surface grooves, and wherein a hydraulic piston is furnished with the second protrusions and second converging slopes.

4. The crane apparatus of claim 1, wherein an intermediate area between the casing and the central part of the rotational driving subsystem is adapted to receive a hydraulic media, which is supplied via hydraulic connectors and is hydraulically connectable to a hydraulic circuit, which is simultaneously intended for powering the first hydraulic cylinder for pivoting the rigid secondary part of the operational arm relatively to the rigid primary part, wherein in the hydraulic circuit during the stage of approaching to a dead position, in which the second pivot point between the rigid primary part and the rigid secondary part of the operational arm is located on a line, which extends through attachment points of the first hydraulic cylinder on the rigid primary part and the rigid secondary part of the operational arm, activation of the rotational driving subsystem is enabled, while during a stage of leaving the dead position the rotational driving subsystem is deactivated.

5. The crane apparatus of claim 1 , wherein the rigid secondary part of the operational arm is telescopic.

* * * * *